US006224469B1

(12) United States Patent
Ohmori et al.

(10) Patent No.: US 6,224,469 B1
(45) Date of Patent: May 1, 2001

(54) COMBINED CUTTING AND GRINDING TOOL

(75) Inventors: Hitoshi Ohmori, Wako; Sei Moriyasu, Tokyo; Takeo Nakagawa, Wako, all of (JP)

(73) Assignee: The Institute of Physical and Chemical Research, Wako (JP)

( * ) Notice: Subject to any disclaimer, the term of this patent is extended or adjusted under 35 U.S.C. 154(b) by 0 days.

(21) Appl. No.: 09/242,018

(22) PCT Filed: Jun. 3, 1998

(86) PCT No.: PCT/JP98/02458

§ 371 Date: Feb. 5, 1999

§ 102(e) Date: Feb. 5, 1999

(87) PCT Pub. No.: WO98/55265

PCT Pub. Date: Dec. 10, 1998

(30) Foreign Application Priority Data

Jun. 5, 1997 (JP) ..... 9-147963

(51) Int. Cl.[7] ..... B24B 01/00

(52) U.S. Cl. ..... 451/56; 451/72; 451/443; 51/307; 51/309

(58) Field of Search ..... 451/56, 443, 72; 125/11.01, 11.22; 51/307, 309

(56) References Cited

U.S. PATENT DOCUMENTS

| | | | | |
|---|---|---|---|---|
| 3,823,515 | * | 7/1974 | Coss, Jr. | 51/322 |
| 3,852,078 | * | 12/1974 | Wakatsuki et al. | 106/43 |
| 4,937,416 | * | 6/1990 | Kubota et al. | 219/69.17 |
| 4,944,773 | * | 7/1990 | Rue et al. | 51/307 |
| 5,091,067 | * | 2/1992 | Ushiyama et al. | 204/129.46 |
| 5,194,126 | * | 3/1993 | Packalin | 204/129.46 |
| 5,547,414 | * | 8/1996 | Ohmori | 451/21 |
| 5,639,363 | * | 6/1997 | Ohmori et al. | 204/652 |
| 5,653,954 | * | 8/1997 | Rosen et al. | 423/594 |
| 5,660,579 | * | 8/1997 | Nakayama et al. | 451/21 |
| 5,833,520 | * | 11/1998 | Kanda et al. | 451/72 |
| 5,868,607 | * | 2/1999 | Enomoto et al. | 451/56 |
| 5,910,040 | * | 6/1999 | Moriyasu et al. | 451/5 |

FOREIGN PATENT DOCUMENTS

| | | |
|---|---|---|
| 59-214561 | 12/1984 | (JP) . |
| 5-318325 | 12/1993 | (JP) . |
| 6-55459 | 3/1994 | (JP) . |
| 7-136936 | 5/1995 | (JP) . |
| 8-309702 | 11/1996 | (JP) . |

OTHER PUBLICATIONS

Microfilm of Japanese Utility Model Application No. 60296/1986 (Laid–open No. 172523/1987) (Ogura Jewel Industry Co., Ltd.), Nov. 2, 1987, p. 4, Lines 4 to 6; Fig. 1.

Microfilm of Japanese Utility Model Application No. 133982/1984 (Laid–open No. 50660/1986) (Toshiba Corp.), Apr. 2, 1986, p. 3, lines 8 to 19; Fig. 3.

* cited by examiner

*Primary Examiner*—Allen Ostrager
*Assistant Examiner*—William Hong
(74) *Attorney, Agent, or Firm*—Griffin & Szipl, P.C.

(57) ABSTRACT

A tool is constructed by a plurality of diamond columns 22 arranged so as to protrude from a working surface and a conductive bond member 24 for integrally fixing the diamond columns. The conductive bond member is electrolytically dressed while a conductive liquid is supplied between the bond member and an electrode 4 which faces the bond member at a distance, thereby enabling the diamond columns 22 to protrude. By this construction, the tool can be applied to both an efficient rough cutting for a ductile material and a precise grinding for a brittle material without detaching or re-attaching a workpiece, the relatively soft ductile material such as aluminum, copper, or plastic can be worked with a deep cut, the brittle material such as monocrystal silicon, glass, or tungsten carbide can be efficiently and stably ground, so that a fluctuation of a working position due to wear can be compensated.

4 Claims, 9 Drawing Sheets

22
24

22
24

22
24

COMBINED CUTTING AND GRINDING TOOL

TECHNICAL FIELD

The present invention relates to a tool for both of cutting and grinding which can be applied to both efficient rough cutting and mirror surface grinding for both ductile materials and hard and brittle materials.

BACKGROUND ART

In manufacturing a metal mold as a base technique in a manufacturing industry, high speed and high quality machining using a machining tool having a high reliability is particularly desired. In metal mold machining, rough cutting is a first process to shape a workpiece into a desired form. The total volume of material which is cut off by rough cutting is very large. Therefore, an extremely high machining efficiency is required in rough cutting. In addition, a machining precision such as surface roughness or surface shape is required in the final product. In order to reduce the whole process time, not only the process time required for rough machining and finish machining is reduced but also a reduction of a set-up time which is needed as part of those processes is important.

As a rough cutting tool for manufacturing the metal mold, a cutting tool such as ball end mill or milling cutter has been widely used. Although the cutting tool can perform efficient rough machining, the shape of the end of the tool is changed due to wear and it is difficult to compensate for this change, so that there is a problem that the machining precision such as surface roughness or surface shape is low.

As a finishing tool for manufacturing the metal mold, a grinding tool using a grinding wheel has been widely used. As for the grinding tool, however, it is difficult to efficiently and stably grind a ductile material such as aluminum, copper, or plastic due to clogging of the grinding surface.

Further, in the case of rough cutting by a rough cutting tool and finishing by a finishing tool, a detachment and a re-attachment of the tool or workpiece is indispensable, so that there is a problem that an occurrence of attachment error cannot be avoided.

In association with a development of the recent technology, desire for ultraprecise machining has rapidly and highly advanced. As electrolytic grinding means which satisfies the above desire, the electrolytic in-process dressing (ELID) grinding method has been developed and proposed by the same applicant as the present invention ("Trend of Latest Technique of Mirror-grinding" in RIKEN Symposium held on the fifth of March, 1992).

The ELID grinding method is a method in which a conductive grinding wheel is used in place of an electrode in the conventional electrolytic grinding, an electrode which faces the grinding wheel at a distance is provided, a voltage is applied between the grinding wheel and the electrode while a conductive liquid is supplied between the grinding wheel and the electrode, and the workpiece is ground by the grinding wheel while dressing the grinding wheel with electrolysis. In the ELID grinding method, even when abrasive grain are fine, no clogging of the grinding wheel occurs by dressing the abrasive grains with electrolytic dressing. Consequently, by using abrasive fine grains, a very excellent surface like a mirror surface can be obtained with ELID grinding. Therefore, it is expected that the ELID grinding method, when applied to various grinding jobs can maintain the cutting ability of the grinding wheel from highly efficient grinding to mirror surface grinding and can form a highly accurate shape in a short time, which cannot be realized by the prior art.

In the ELID grinding method, although it is possible to grind at a high efficiency without clogging of the grinding wheel, it is difficult to eliminate chips with respect to relatively soft, ductile material such as aluminum, copper, or plastic, because such materials cannot be deeply cut. Therefore, there is a problem that the machining efficiency is lower than that as a conventional cutting tool such as a ball end mill or milling cutter.

DISCLOSURE OF THE INVENTION

The present invention is invented in order to solve the above-mentioned various problems. That is, it is a main object of the present invention to provide a tool for both cutting and grinding which can be applied to both efficient rough cutting and mirror surface grinding for a ductile material and a hard and brittle material without detaching and re-attaching a tool or a workpiece. Another object of the present invention is to provide a tool for both cutting and grinding which can compensate for tool wear.

According to the invention, there is provided a tool for both cutting and grinding comprising: a plurality of diamond columns regularly arranged so as to protrude on a working surface; and a conductive bond member for integrally fixing the diamond columns, wherein the conductive bond member can be electrolytically dressed while a conductive liquid is supplied between the conductive bond member and an electrode which faces the bond member at a distance.

According to the construction of the invention, the conductive bond member which integrally fixes the diamond columns can be electrolytically dressed while the conductive liquid is supplied between the bond member and electrode which faces the bond member at a distance. Therefore, when a chip of each diamond column is worn, a protruding amount of the diamond column from the conductive bond member is reduced, and work resistance increases, the surface of the conductive bond member is eliminated by the electrolytic dressing, so that the protruding amount of each diamond column can be increased. Therefore, the protruding amount can be always optimized, the chip of the diamond column functions as a cutting blade, and the efficient rough cutting and mirror surface grinding for the relatively soft ductile material such as aluminum, copper, or plastic and the hard and brittle material such as monocrystal silicon, glass, or carbide alloy can be machined without detaching and re-attaching the tool or workpiece. Since the shape of the tool chip is hardly changed even when the tool is worn due to the machining, the excellent surface like a mirror surface can be realized and the tool wear can be easily compensated as a decreasing amount of the tool diameter.

According to a preferred embodiment of the invention, the conductive bond member is in a disc shape or a cylindrical shape and chips of the plurality of diamond columns are located on either one or both of the bottom surface and the peripheral surface of the disc or cylinder. By the construction, it can be used. as disk shaped or cylindrical shaped cutting tool and grinding wheel.

It is preferable that the diamond column comprise of monocrystal abrasive grains comprising a monocrystal having a relatively small size and polycrystal abrasive grains having a relatively large size. By this construction, the rough cutting can be executed by the polycrystal abrasive grains comprising large polycrystal at a high efficiency and the high precise grinding can be executed by the monocrystal abrasive grains comprising small monocrystal.

It be preferable that the conductive bond member is a conductive grinding wheel containing abrasive grains. By this construction, the efficient grinding of the workpiece can be executed by coming into contact with the conductive bond member.

Other objects and advantageous features of the present invention will become apparent from the following description with reference to the accompanying drawings.

BEST MODE FOR CARRYING OUT THE INVENTION

Figure 1:
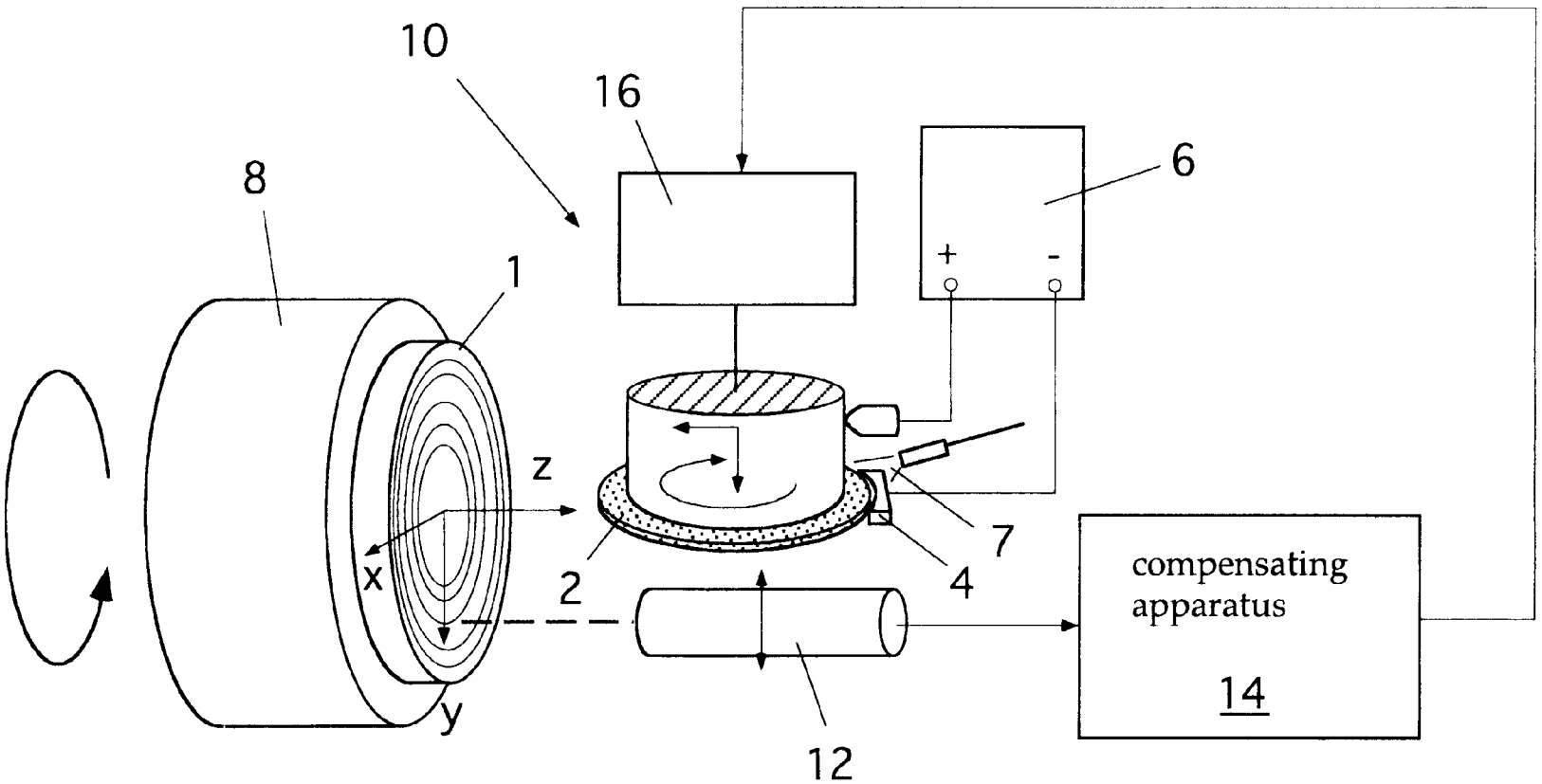
FIG. 1 is a schematic view of a working apparatus using a tool for both of cutting and grinding of the present invention.

A preferred embodiment of the present invention will now be described hereinbelow with reference to the drawings. The same reference numerals shall apply to common portions in the drawings and overlapped explanations will be omitted.

FIG. 1 is a schematic view of a machining apparatus using a tool for both of cutting and grinding according to the present invention. In the figure, a machining apparatus 10 comprises a tool 2 for both cutting and grinding which processes a workpiece 1, an electrode 4 which faces the working surface of the tool 2 at a distance, and an voltage applying device 6 which applies a voltage between the tool 2 and the electrode 4. A conductive liquid 7 is supplied between the tool 2 and the electrode 4, whereby the tool 2 can be electrolytically dressed. In the figure, the workpiece 1 is attached to a rotating table 8, and it is rotated around a z axis, and it is moved in the z axial direction. The tool 2 is rotated around an axis which is parallel to a y axis and is moved in the x axial direction. Its contact position (working position) with the workpiece 1 can be numerically controlled by a control device 16.

The working apparatus 10 further comprises a shape measuring device 12 for measuring a shape of the working surface and a compensating apparatus 14 for compensating command data to numerically control. The shape measuring device 12 is, for example, a digital contracer or a laser micrometer having a high measuring resolution. The device is attached to a position which is not influenced to the work of the workpiece 1 by the tool 2 and can precisely measure the shape of the working surface without detaching the workpiece 1 from the rotating table 8. The compensating apparatus 14 adds a correction on the basis of error data obtained by filtering the measurement data, thereby forming new command data. By this construction, the positional deviation due to the attachment and detachment of the tool is prevented, whereby adjustment is not needed to be realized.

Figure 2A:
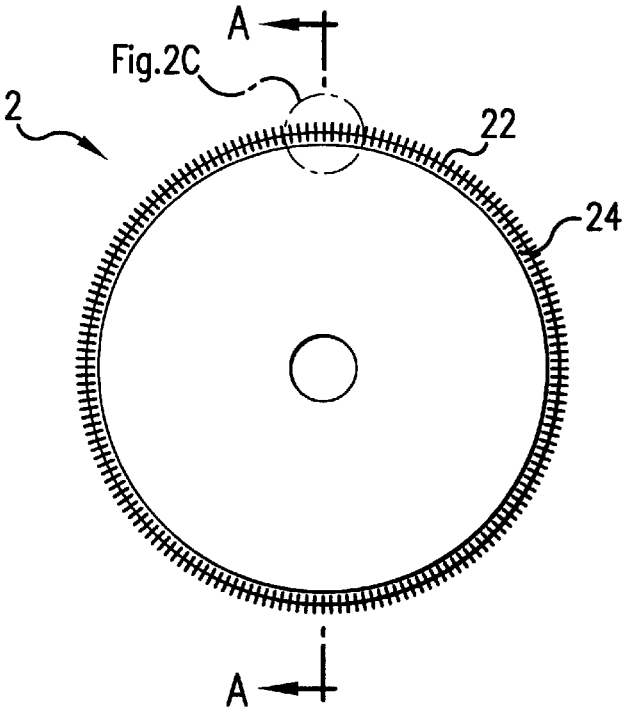
FIG. 2 are schematic views of the tool for both of cutting and grinding of the invention.
Figure 2B:
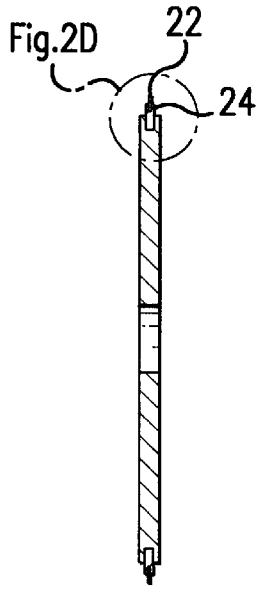
Figure 2C:
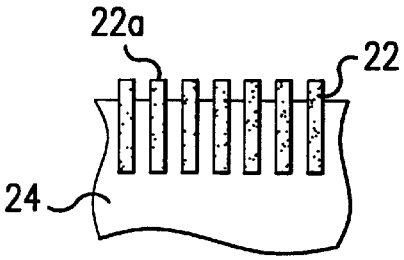
Figure 2D:
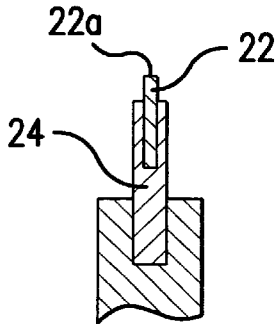

FIGS. 2A to 2D are schematic views of the tool for both cutting and grinding according to the invention. In the figures, FIG. 2A is a front view, FIG. 2B is a cross sectional view taken along the line A—A in FIG. 2A, FIG. 2C is an enlarged view of a B portion in FIG. 2A, and FIG. 2D is an enlarged view of a C portion in FIG. 2B.

As shown in the figures, a tool 2 for both of cutting and grinding of the invention comprises a plurality of diamond columns 22 regularly arranged so as to protrude on the working surface, and a conductive bond member 24 for integrally fixing the diamond columns 22. The conductive bond member 24 can be electrolytically dressed while the conductive liquid is allowed to flow between the bond member and the electrode 4 which faces the bond member at a distance as mentioned above.

In the embodiment in FIG. 2, the conductive bond member 24 has a disc-shape whose diameter is 75 mm and in which chips 22*a* of the plurality of (in this example, 235 pieces) diamond columns 22 are located on the peripheral surface of the disc. That is, the 235 pieces of diamond columns 22 are embedded like cutting blades in the radial direction along the peripheral surface of the disc. Each diamond column 22 is synthetic diamond which has a rectangular cross section whose one side is equal to about 0.2 mm and which has a length of about 2 mm. The diamond columns 22 are integrally fixed by the conductive bond member 24. Brazing or powder metallurgy can be used for fixing. Further, a variation in the amount that the diamond column 22 protrudes from the conductive bond member 24 is formed so as to be sufficiently small (for example, 5 $\mu$m or less) by mechanical truing.

It is desirable that the conductive bond member 24 a conducive grinding wheel containing abrasive grains. The invention is not limited to this material but it is sufficient if the grinding wheel does not contain abrasive grains.

Figures 3A, 3B, 3C:
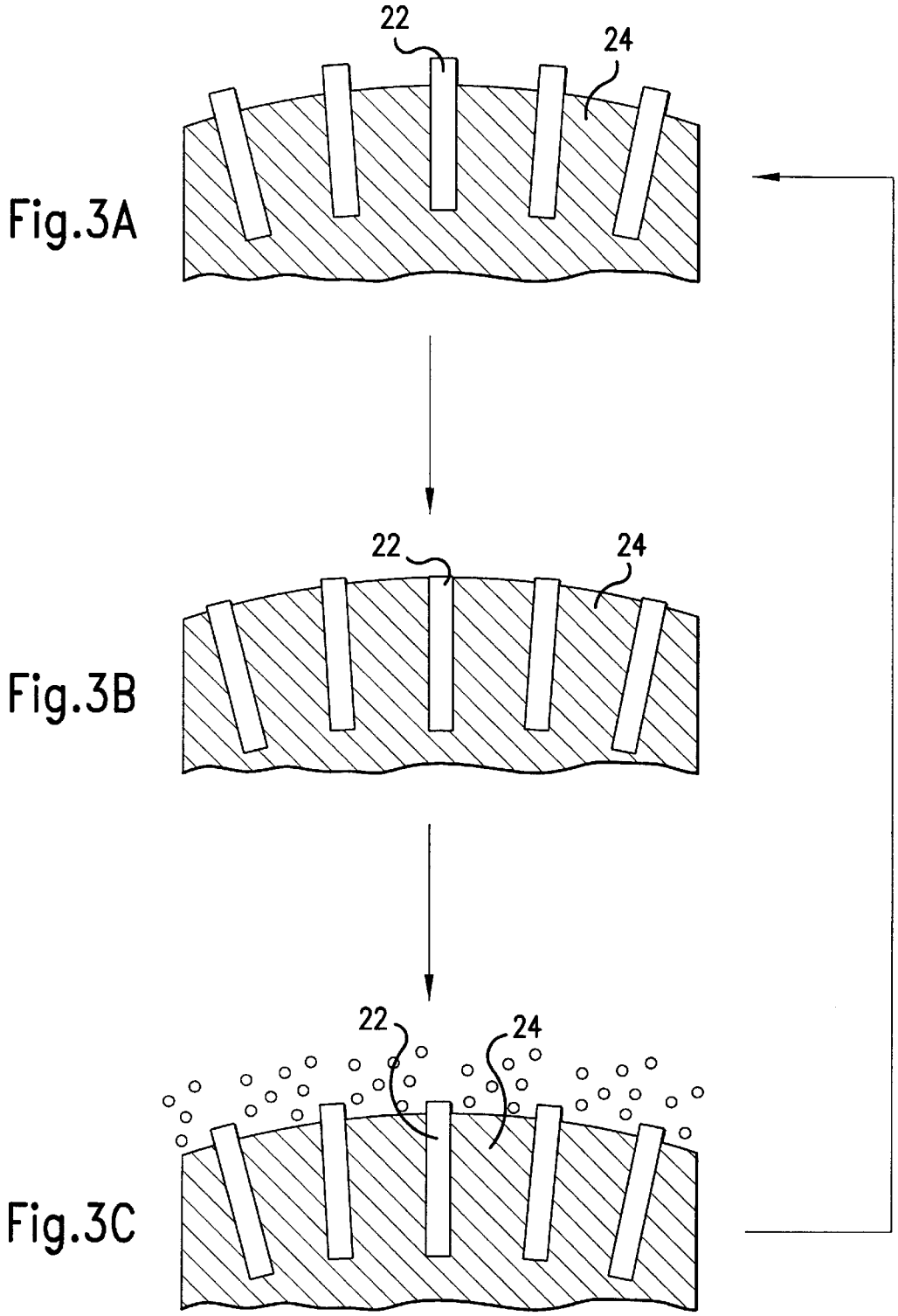
FIG. 3 are explanatory views of a principle of the invention.
Figure 4A:
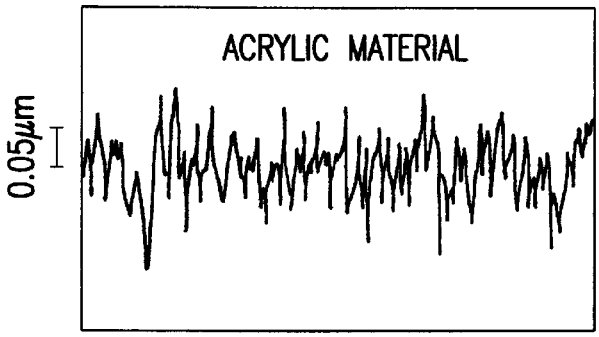
FIG. 4 are graphs showing an embodiment of the invention.
Figure 4B:
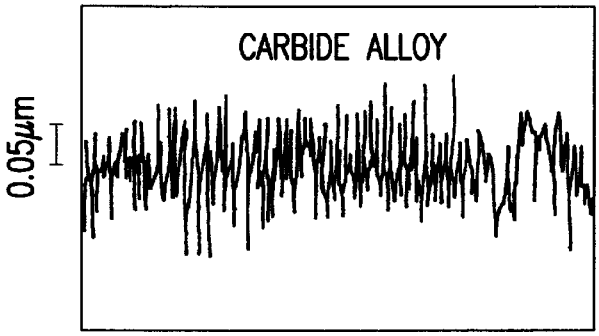
Figure 4C:
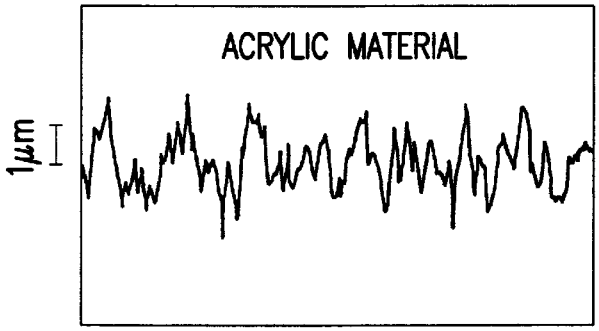
Figure 4D:
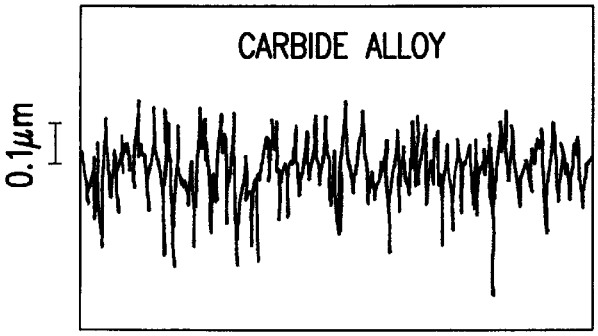

FIGS. 3A to 3C are an explanatory views of the principle of the invention. In the figures, FIG. 3A shows the surface of the tool which is fine as a cutting tool in which each diamond column 22 protrudes from the conductive bond member 24. FIG. 3B shows the surface of the tool after the diamond columns 22 are worn and FIG. 3C shows a state in which the diamond columns 22 are made to protrude by electrolytically dressing.

In FIG. 3A, as the cutting is continued by using the above-mentioned tool 2 for both of cutting and grinding, the chip portions of the diamond columns 22 are worn. As shown in FIG. 3B, when the protruding amount of each diamond column 22 from the conductive bond member 24 is not enough, the load increases by the working resistance, so that the cutting cannot be executed. In order to avoid such a situation, as shown in FIG. 3C, the conductive bond member 24 is dissolved by electrolytically dressing, the chip of each diamond column 22 is allowed to again protrude from the conductive bond member 24, and the fine surface of the tool shown in FIG. 3A is reconstructed.

By repeating the processes of FIGS. 3A to 3C, the tool surface can e always kept in a good state as a cutting tool and its life is very longer than that of the conventional cutting tool.

EXAMPLES

By using the machining apparatus 10 shown in FIG. 1, machining tests by the tool 2 for both of cutting and grinding were carried out. In order to compare with the results, a conventional grinding wheel was also used. The diameter of each tool was equal to about 75 mm and the width (thickness) was equal to 3 mm. As a workpiece 1, an acrylic material (diameter: 20 mm, length: 25 mm) and carbide alloy (diameter: 20 mm, length: 25 mm) were used.

Example 1

An acrylic material (PMMA) was used as an example of a ductile material. In order to grasp fundamental characteristics, the material was flattened, and after completion of the flattening, a roughness of the surface was measured. In order to compare with the present tool, a grinding stone of #400 (mean grain diameter is about 0.03 mm) was used.

Example 2

As an example of a hard and brittle material, carbide alloy was used. Since the work resistance was large, a control to set a peripheral speed to be constant was executed.

Example 3

In order to apply a shape control of a high precision, the machining apparatus 10 shown in FIG. 1 was used and an aspheric surface whose radius of curvature of the center is equal to 100 mm was manufactured. As for the shape control of the aspheric surface, at first, it was cut and grinded on the basis of NC data, a machined shape was measured and an error was calculated. Then correction data was calculated by a computer, and a re-work on the basis of the correction data was repeated.

FIG. 4 are graphs showing the embodiments of the invention. FIG. 4A shows roughness of the surfaces by the tool of the invention and FIG. 4B shows roughness of the surfaces by the grinding wheel. In each view, an upper graph shows a case of the acrylic material and a lower graph shows a case of the carbide alloy. It will be understood from FIG. 4 that in spite of a fact that the diameter of the abrasive grain is larger than that of the grinding wheel, the more precise working surface has been accomplished by the tool of the invention. Since the protruding amount of the abrasive grains is set to be large, the machining efficiency by the tool of the invention is more proper than that of the grinding wheel. Further, it is very important that a workpiece made of carbide alloy can be cut by the tool of the invention. The reason is that carbide alloy as a hard and brittle material could be hardly worked by the conventional cutting tool.

Figure 5A:
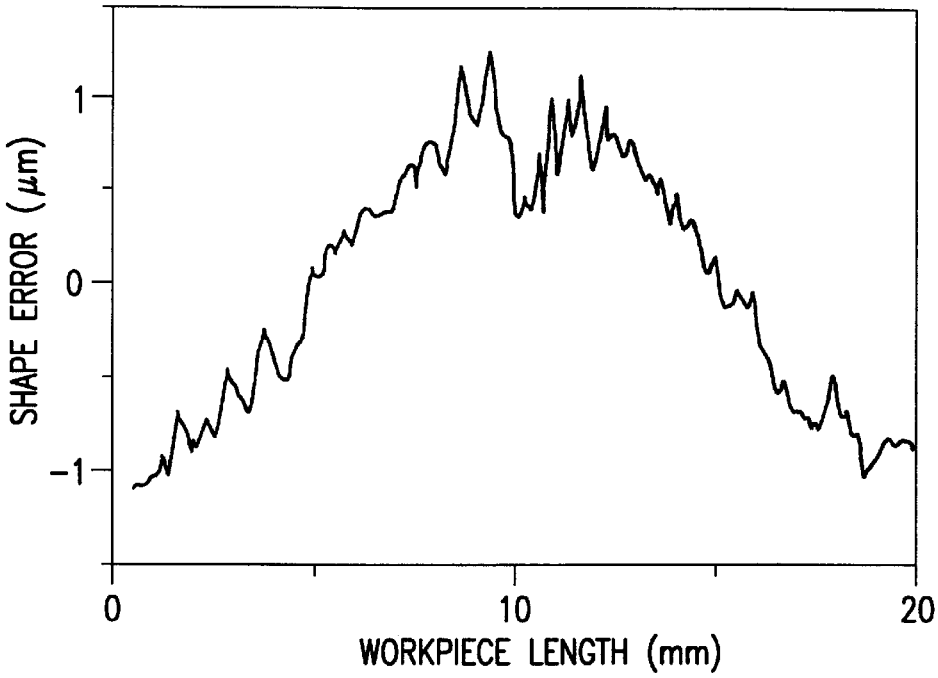
FIG. 5 are the other graphs showing the embodiment of the invention.
Figure 5B:
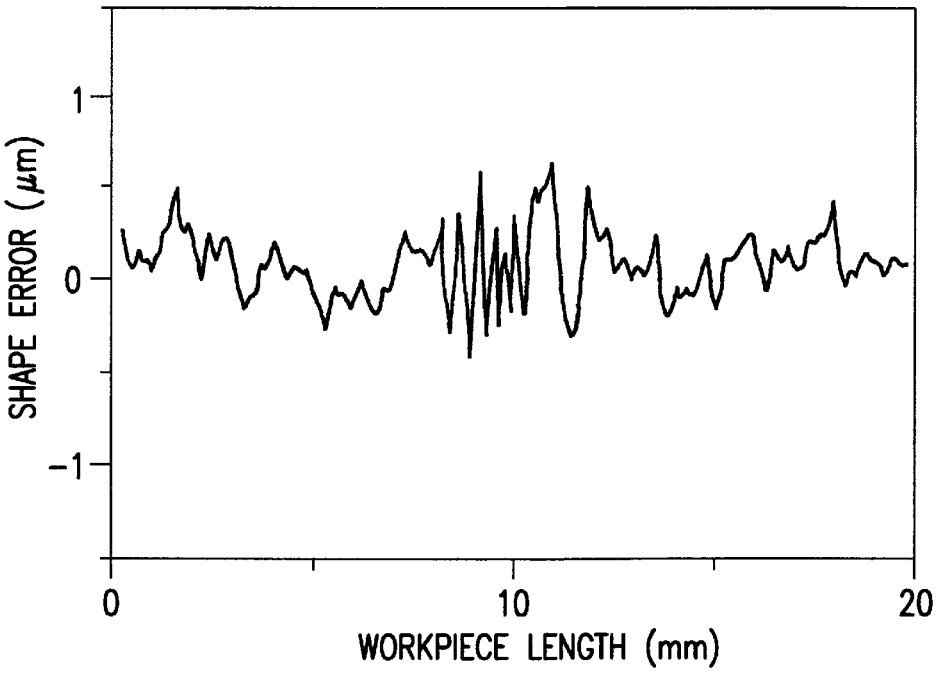

FIG. 5 is another embodiment showing the invention. FIG. 5A shows a shape error before the shape compensation and FIG. 5B shows a shape error after the shape compensation. A shape error of 2.4 $\mu$m as maximum before the shape compensation was changed to 0.97 $\mu$m as maximum after the shape compensation. It will be understood from this data that the shape control efficiently functions.

Figure 6:
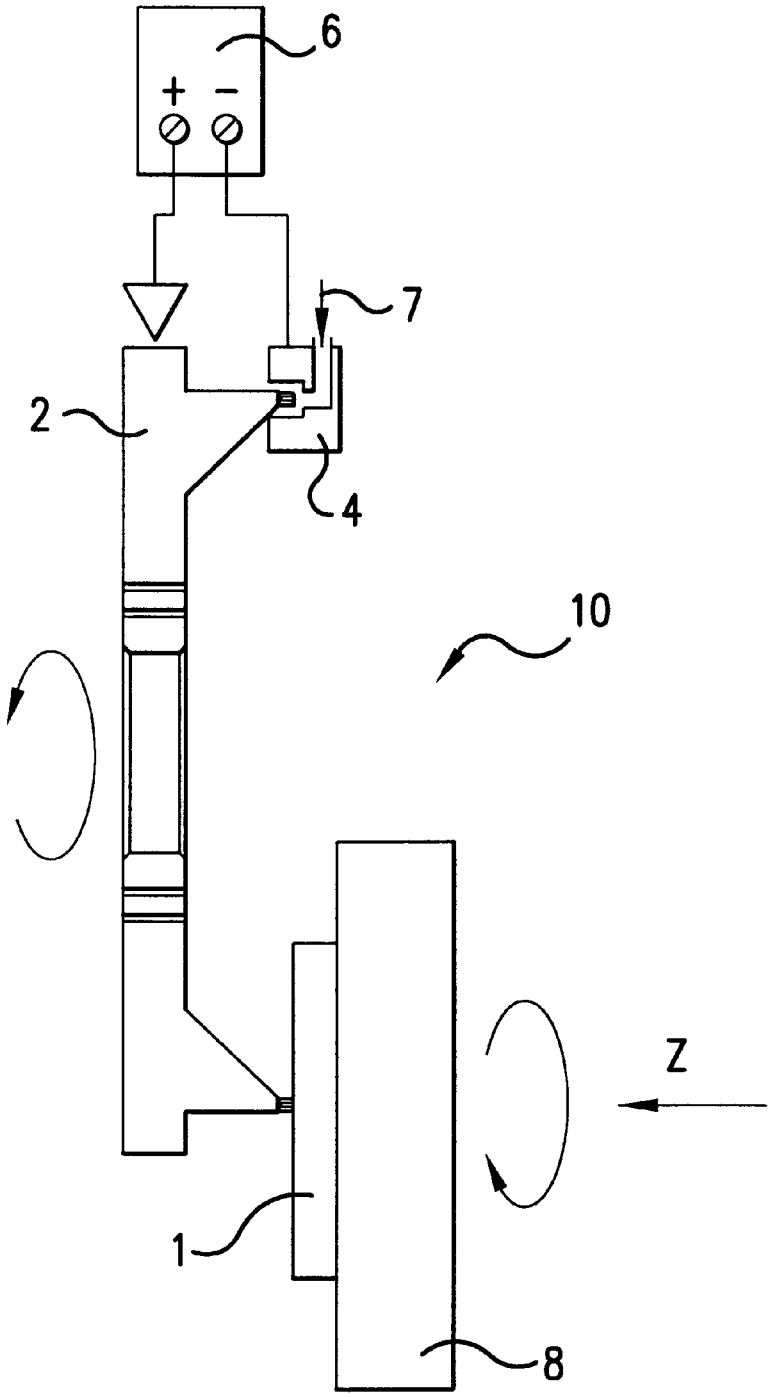
FIG. 6 is another schematic view of the working apparatus using the tool for both cutting and grinding according to the invention.

FIG. 6 is another schematic view of the machining apparatus using the tool for both of cutting and grinding of the invention. In the view, the workpiece 1 is attached to the rotating table 8, it is rotated around the z axis as a center, and is moved in the z axial direction. The tool 2 is rotated around an axis that is parallel to the z axis. A contact position (working position) where the workpiece 1 comes into contact with the tool 2 can be numerically controlled.

Figure 7A:
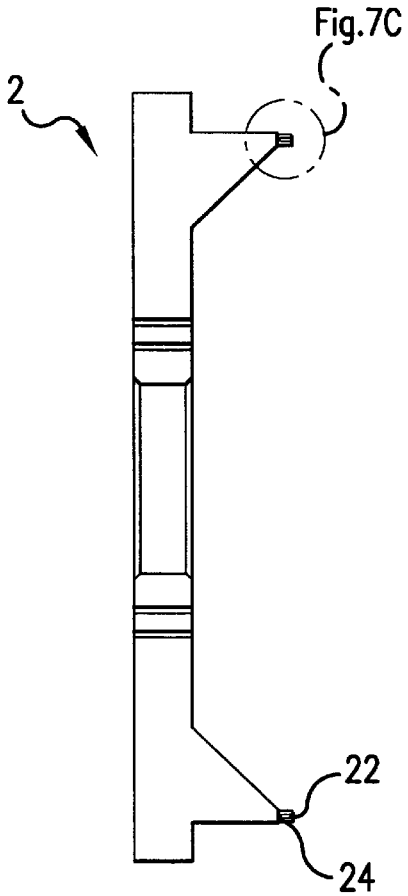
FIG. 7 are the other schematic views of the tool for both of cutting and grinding of the invention.
Figure 7B:
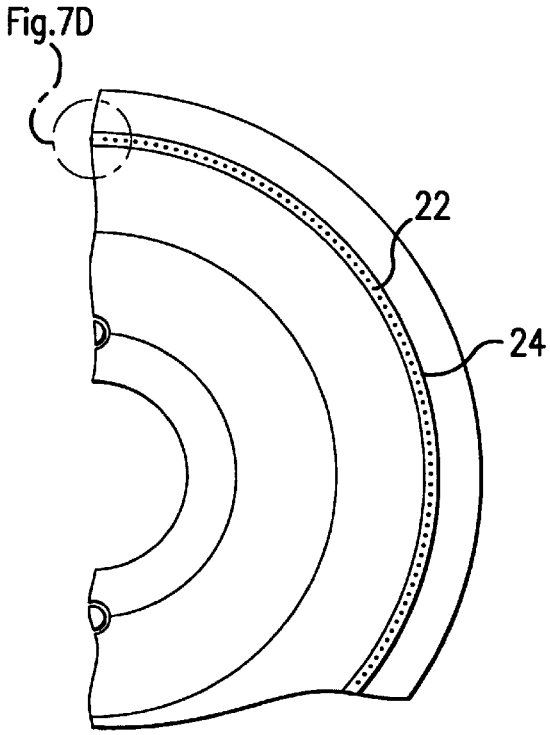
Figure 7C:
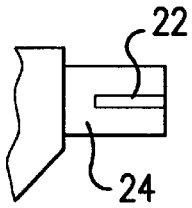
Figure 7D:
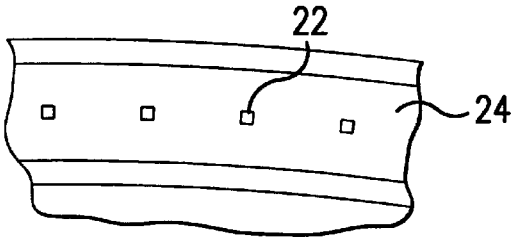

FIGS. 7A to 7D are another schematic views of the tool for both of cutting and grinding of the invention. In the figures, FIG. 7A is a front view, FIG. 7B is a side sectional view, FIG. 7C is an enlarged view of an A portion in FIG. 7A, and FIG. 7D is an enlarged view of a B portion in FIG. 7B. As shown in the figures, the tool 2 for both of cutting and grinding of the invention comprises the plurality of diamond columns 22 regularly arranged so as to protrude from the working surface, and the conductive bond 24 for integrally fixing the diamond columns 22. The conductive bond 24 can be electrolytically dressed while the conductive liquid is supplied between the bond member and the electrode 4 which faces the bond member 24 at a distance as mentioned above.

Figure 8A:
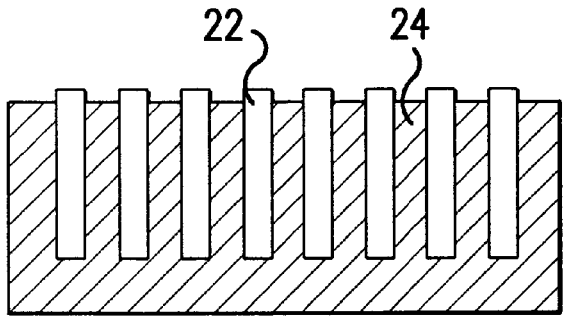
FIG. 8 are explanatory views of another principle of the invention.
Figure 8B:
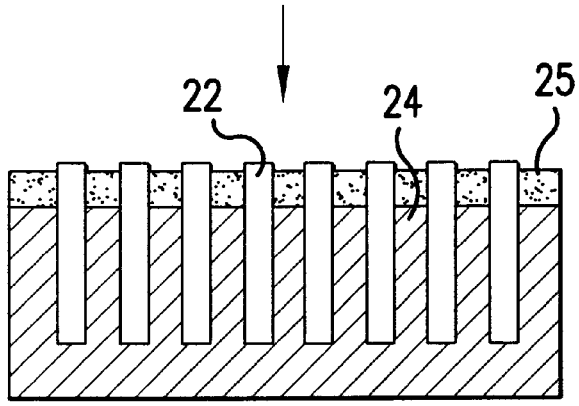
Figure 8C:
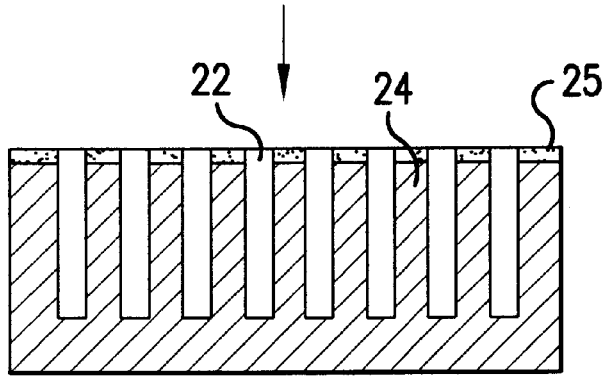
Figure 8D:
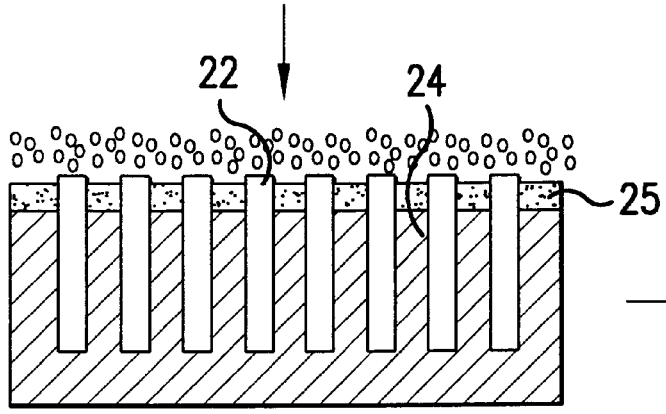

FIGS. 8A to 8D are schematic views of another principle of the invention. In the figures, FIG. 8A shows the surface of the tool just after a truing, in which each diamond column 22 is protruded from the conductive bond member 24. FIG. 8B shows a state in which the conductive bond member 24 is dissolved by the electrolytic dressing and an oxide film 25 is formed on the surface, so that it is prevented that the conductive bond member 24 is one-sidedly dissolved. FIG. 8C shows the surface of the tool after the wear of the diamond columns 22, in which the protruding amount of each diamond column 22 is held to be constant. FIG. 8D shows a state in which the oxide film 25 is again formed on the surface of the conductive bond member 24 by electrolytically dressing and the diamond columns 22 are being processed so as to protrude.

In FIG. 8A, after the above-mentioned tool 2 for both of cutting and grinding is trued, the oxide film 25 is formed on the surface by electrolytically dressing. In FIG. 8B, as the process is continued, the chip portion of each diamond column 22 is worn. As shown in FIG. 8C, when he protruding amount of the diamond column 22 from the conductive bond 24 becomes insufficient, the load increases due to the work resistance, so that it is impossible to cut. In order to avoid such a state, as shown in FIG. 8D, the conductive bond member 24 is dissolved by electrolytically dressing and the oxide film 25 is formed on the surface, the chip of each diamond column 22 is set so as to protrude from the conductive bond member 24, so that the fine tool surface shown in FIG. 8B is reconstructed.

By repeating the processes of FIG. 8B to FIG. 8D, the tool surface can be always kept in the fine state as a cutting tool and the life is longer than that of the conventional cutting tool.

From the above-mentioned embodiments and examples, it can be said that the tool for both of cutting and grinding of the invention has the following features.

1. As compared with a single-point tool, (1) since the tool has many working blades and its cutting ability is high, the efficient work can be performed; (2) since it is an intermittent work, heat which occurs upon working can be dispersed, so that the wear of the tool can be reduced; (3) since the worn cutting blades can be again protruded by electrolytically dressing, the tool life can be increased; and (4) the hard and brittle material can be efficiently worked.

2. As compared with the ball end mill and the milling cutter, (1) since the shape of the cutting blade is hardly changed due to the wear of the tool, the quality of the surface can be raised; (2) the working ability of the tool can be adjusted by electrolytically dressing; (3) the quality of the working surface can be maintained by adjusting the protrusion of the cutting blade by electrolytically dressing; (4) since the diamond is used, the life is long for non-ferrous metal; and (5) as for the shape work, although the shape of the tool chip of the ball end mill or the like is changed, the compensation of the tool wear can be easily performed by detecting a decreasing amount of the diameter.

3. As compared with the grinding wheel, (1) the ductile material can be easily worked without clogging; (2) the ductile material can be cut at a high efficiency and a high precision; and (3) it can be expected that a excellent surface finishing is accomplished at a high removal ratio.

Figure 9:
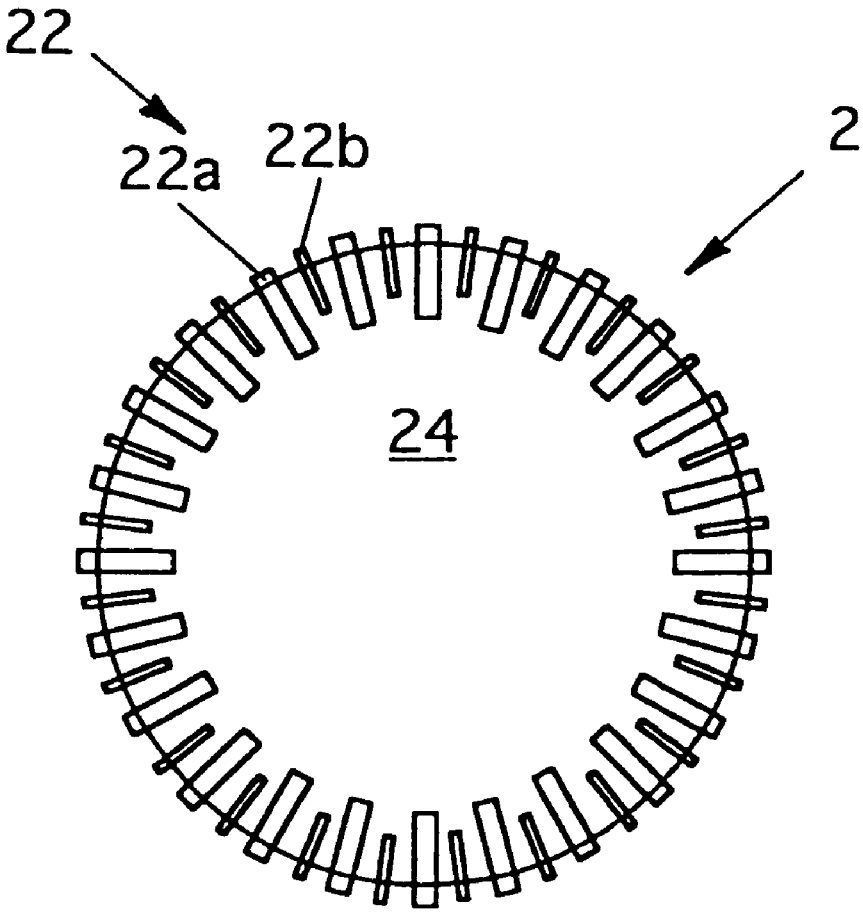
FIG. 9 is further another schematic view of the tool for both of cutting and grinding of the invention.

FIG. 9 is further another schematic view of the tool for both of cutting and grinding of the invention. In the figure, each diamond column 22 is constituted of the monocrystal abrasive grains 22*a* comprising monocrystal having a relatively small size and polycrystal abrasive grains 22*b* comprising polycrystal having a relatively large size. The monocrystal abrasive grains 22*a* and polycrystal abrasive grains 22*b* are embedded in a proper arrangement on the base (conductive bond member 24) made of high molecular compound containing metal or a conductive material on the surface of the tool, thereby constructing the tool 2. It is desirable that monocrystal diamond is used as monocrystal abrasive grains and sintered diamond (PCD) is used as polycrystal abrasive grains. As for the tool 2 for both of cutting and grinding having the above-mentioned construction, when the tool just after the truing is used for the cutting, the cutting is progressed by the polycrystal abrasive grains 22*b* having a large size, the rough cutting can be executed at a high efficiency. After completion of the rough cutting, since the abrasive grains 22*b* comprising polycrystal is dissolved by electrolytically dressing, the chip of each abrasive grain is backed. Therefore, the grinding is progressed by the monocrystal abrasive rains 22*a* having a small size as a main, so that the high precision surface can be obtained by using the same tool. A hard and brittle material such as glass or ceramics can be ground at efficiency higher than that of the conventional grinding by using the tool. In the ductile material such as metal or the like, the surface having a quality higher than that of the conventional grinding can be obtained.

As mentioned above, the tool for both of cutting and grinding of the invention has such excellent effects that it can be applied to both of the efficient rough cutting and mirror surface grindig for the ductile material and the hard and brittle material without detaching and re-attaching the tool, the relatively soft ductile material such as aluminum, copper, or plastic can be cut with a deep cut and the hard and brittle material such as monocrystal silicon, glass, or cemented carbide can be effectively and stably ground, further in the shape work, the amount of the tool worn can be easily compensated as a decreasing amount of the tool diameter, and the like.

Although the invention has been described in its preferred embodiments, it will be understood that the right scope included in the invention is not limited to those embodiments. On the contrary, the right scope of the invention contains all of an improvement, a modification and an equivalent covered in the appended claims.

What is claimed is:

1. A tool for both cutting and grinding, comprising:

a plurality of diamond columns regularly arranged so as to protrude from a working surface of the tool; and a conductive bond member for integrally fixing said diamond columns, wherein said conductive bond member is electrolytically dressable if a voltage is applied between the tool and an electrode spaced from the tool while conductive liquid flows between the tool and the electrode;

wherein said plurality of diamond columns comprise a mixture of monocrystal abrasive grains and polycrystal abrasive grains comprising polycrystal having a size relatively larger than said monocrystal grains.

2. The tool for both of cutting and grinding according to claim 1, wherein said conductive bond member is a conductive grinding wheel containing further abrasive grains.

3. The tool for both of cutting and grinding according to claim 1, wherein said conductive bond member is disc-shaped or cylindrical-shaped and chips of said plurality of diamond columns are located on either one or both of a bottom surface and a peripheral surface.

4. A tool for both cutting and grinding, comprising:

a plurality of diamond columns regularly arranged so as to protrude from a working surface of the tool; and a conductive bond member for integrally fixing said diamond columns, wherein said conductive bond member is electrolytically dressable if a voltage is applied between the tool and an electrode spaced from the tool while conductive liquid flows between the tool and the electrode, and wherein said bond member comprises further abrasive grains;

wherein said plurality of diamond columns comprise a mixture of monocrystal abrasive grains and polycrystal abrasive grains comprising polycrystal grains having a size relatively larger than said monocrystal grains.

* * * * *